US007433764B2

(12) United States Patent
Janssen

(10) Patent No.: US 7,433,764 B2
(45) Date of Patent: Oct. 7, 2008

(54) METHOD AND SYSTEM FOR RECORDING A TRAFFIC VIOLATION COMMITTED BY A VEHICLE

(75) Inventor: Theodorus Maria Janssen, Spaarndam (NL)

(73) Assignee: Gatsometer B.V., Haarlem (NL)

( * ) Notice: Subject to any disclaimer, the term of this patent is extended or adjusted under 35 U.S.C. 154(b) by 224 days.

(21) Appl. No.: 10/511,476

(22) PCT Filed: Apr. 15, 2003

(86) PCT No.: PCT/NL03/00288

§ 371 (c)(1),
(2), (4) Date: Aug. 19, 2005

(87) PCT Pub. No.: WO03/088177

PCT Pub. Date: Oct. 23, 2003

(65) Prior Publication Data

US 2006/0047371 A1 Mar. 2, 2006

(30) Foreign Application Priority Data

Apr. 15, 2002 (NL) ..... 1020386

(51) Int. Cl.
*G08G 1/00* (2006.01)

(52) U.S. Cl. ..... 701/1; 382/105

(58) Field of Classification Search ..... 701/117, 701/119, 1; 382/105, 106; 340/933, 941, 340/937, 928, 988; 348/148, 149
See application file for complete search history.

(56) References Cited

U.S. PATENT DOCUMENTS

| | | | | |
|---|---|---|---|---|
| 3,222,682 | A * | 12/1965 | Scott | 396/317 |
| 5,801,943 | A | 9/1998 | Nasburg | |
| 5,850,191 | A * | 12/1998 | Yagi et al. | 340/928 |
| 5,948,038 | A | 9/1999 | Daly et al. | |
| 6,546,119 | B2 * | 4/2003 | Ciolli et al. | 382/104 |
| 6,573,929 | B1 * | 6/2003 | Glier et al. | 348/149 |
| 6,650,765 | B1 * | 11/2003 | Alves | 382/105 |
| 7,068,185 | B2 * | 6/2006 | Kavner | 340/933 |

FOREIGN PATENT DOCUMENTS

| | | |
|---|---|---|
| GB | 2 266 398 A | 10/1993 |
| WO | WO 01/20581 A1 | 3/2001 |

* cited by examiner

*Primary Examiner*—Dalena Tran
(74) *Attorney, Agent, or Firm*—Morgan, Lewis & Bockius LLP; Richard F. Trecartin; Victor E. Johnson

(57) ABSTRACT

The invention relates to a method for recording a traffic violation in which a vehicle is involved, by detecting the violation, making a record of the violation, and searching for and reading from the record a license plate of the vehicle involved in the violation. During making of the record position information of the vehicle is herein recorded, and on the basis of this information a search is made for the license plate in only a part of the record. The recorded position information can comprise the travel direction of the vehicle, or the lane in which the vehicle is located. The record can be a picture record wherein a search for the license plate is made, on the basis of the recorded travel direction, only in a left or right-hand half or, on the basis of the recorded position information, only in a narrow strip. The invention also relates to a system for performing the method.

34 Claims, 4 Drawing Sheets

METHOD AND SYSTEM FOR RECORDING A TRAFFIC VIOLATION COMMITTED BY A VEHICLE

Figure 1:
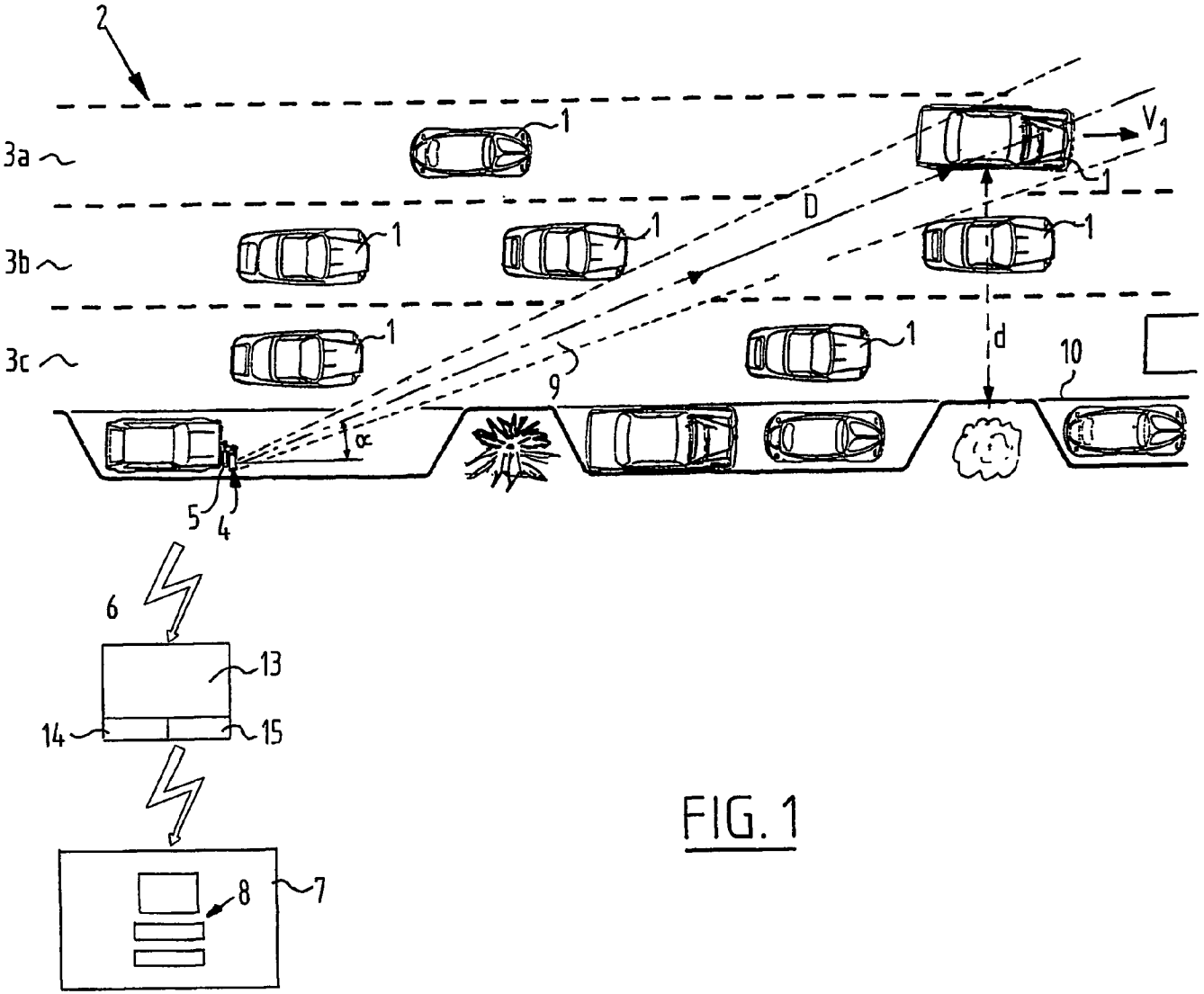

The invention relates to a method for recording an incident, in particular a traffic violation, in which a vehicle is involved, comprising the steps of detecting the incident, making at least one record of the detected incident, and searching for and reading from the record a license plate of the vehicle involved in the incident. Such a method is generally known, and is applied for instance to record, using camera equipment, traffic offences such as driving through a red light, exceeding the maximum speed limit and the like.

In the known method the offence can be detected by induction loops in the road surface or by a speed measuring device which emits a signal and receives and analyses a signal reflected by a vehicle. The camera equipment is activated when an offence is ascertained. This makes one or more picture records which then have to be examined in order to establish the nature and seriousness of the offence, and to identify the vehicle with which the offence was committed. Data relating to the violation, for instance the measured and the maximum allowed speed, are already displayed in the record(s).

For this purpose use has generally been made heretofore of analog cameras with normal film, because these still have a considerably higher resolution than digital cameras. The use of analog cameras entails that each picture record first has to be developed and printed before it can be examined. This examination is done by police officers, who examine the record, search for the offending vehicle therein and read the license plate thereof. In addition, the officer reads the data also displayed relating to the violation. All these data are then used to write out a ticket which is sent to the owner of the registration.

Examining the records is time-consuming and monotonous work, wherein errors can easily be made after a period of time. This furthermore requires large-scale use of relatively scarce personnel. In addition, the corrective effect of the ticket is slight owing to the long period of time which elapses between the moment the violation has been detected and the moment that the record is processed and the ticket can be sent, in practice several weeks.

It has therefore already been proposed to automate processing of the records made. It is hereby possible to save on personnel costs, while the elapsed time between violation and ticket can also be shortened. Use can herein be made of conventional analog picture records which are digitized prior to processing, but it is also possible to envisage making use of digital records which can be processed directly. One problem up until now standing in the way of automated processing of this type of record is the computing capacity required. A record with a sufficient resolution to enable identification and reading of license plates therein has such a large number of pixels that processing thereof in a reasonable time is only possible using very powerful computers. An automatic processing thus requires a relatively large investment.

The invention now has for its object to provide a method of the above described type, wherein said drawbacks do not occur. According to the invention this is achieved in that during making of the record information is recorded relating to the position of the vehicle, and on the basis of this information a search is made for the license plate in only a part of the record. By thus searching in this specific manner and only examining a part of the record, the method can be performed using relatively simple and inexpensive computer equipment.

The recorded position information may comprise the travel direction of the vehicle or the lane in which the vehicle is located. The search field can be at least halved in this way. When the incident is a traffic violation, which is detected by emitting a signal and analysing a signal reflected by the vehicle, a set transmission range is preferably recorded as position information. These variants have the advantage that the position information has only to be inputted once at the start of a series of detections.

Conversely, when the incident is a traffic violation detected by making use of a number of fixed detection elements, the identity of the detection element detecting the violation can be recorded as position information.

A very great limitation of the search field is achieved when during detecting of the violation the distance to the vehicle is measured and recorded as position information.

When the record is a picture record and the recorded position information comprises the travel direction of the vehicle, a search for the license plate is advantageously made, on the basis of the recorded travel direction, only in a left or right-hand half of the record. When the recorded position information includes the lane in which the vehicle is located, it is only necessary to search for the license plate, on the basis of the recorded position information, in a relatively narrow vertical strip of the record.

When a plurality of vehicles are caught in the record, a search is preferably made, on the basis of the recorded position information, for the license plate of only one of the vehicles. A considerable reduction in the processing time is hereby possible, while the risk of a registered owner wrongly receiving a ticket is thus also greatly reduced.

The invention also relates to a system for performing the above described method. A conventional system for recording an incident, in particular a traffic violation, in which a vehicle is involved, comprises means for detecting the incident, means connected to the detecting means for making at least one record of the detected incident, and means for searching for and reading from the record a license plate of the vehicle involved in the incident. The system according to the invention herein has the feature that recording means are adapted to record information relating to the position of the vehicle, and the search and read means are adapted to search for the license plate, on the basis of this information, in only a part of the record.

When the recording means are adapted to make picture records, the search and read means are preferably adapted to identify and read the license plate by optical means. For this purpose the search and read means can comprise software for optical character recognition.

Figure 2:
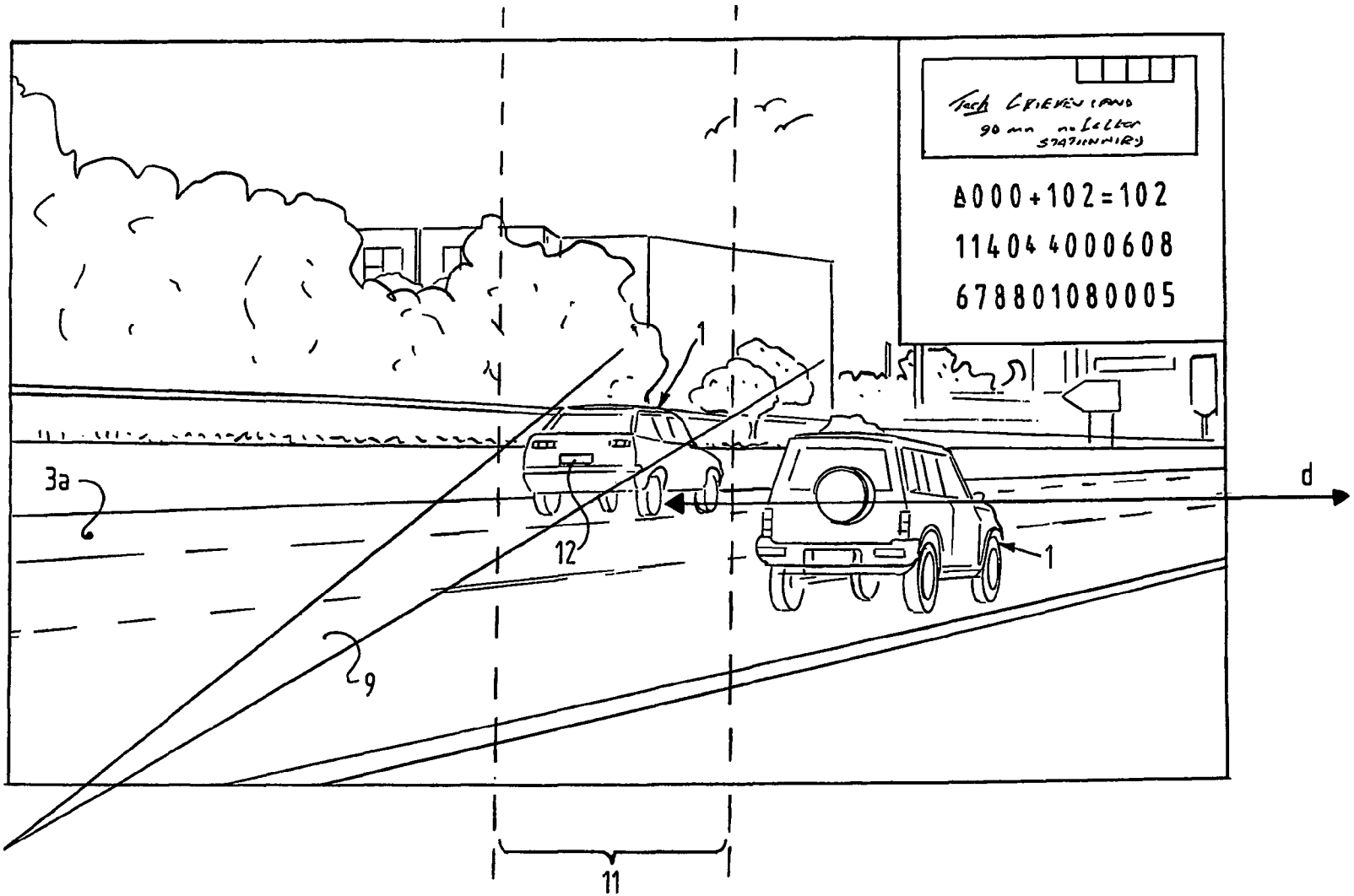
Figure 3:
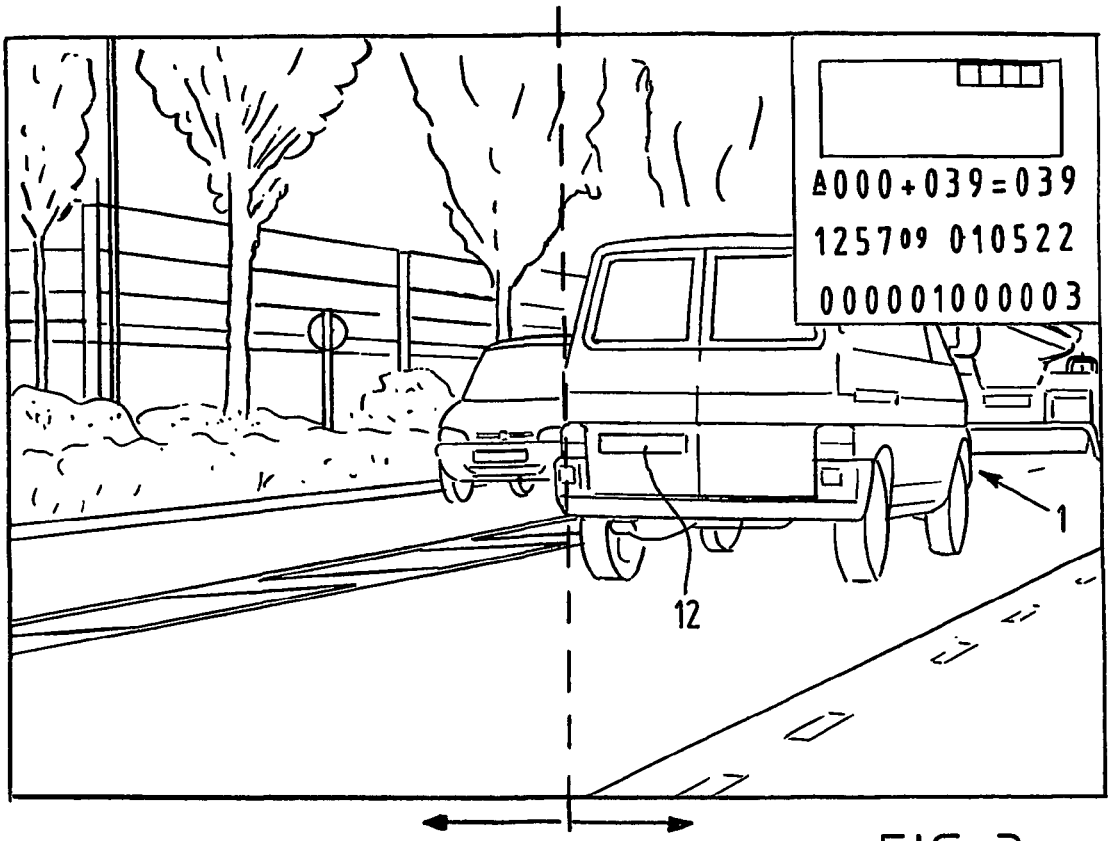
Figure 4:
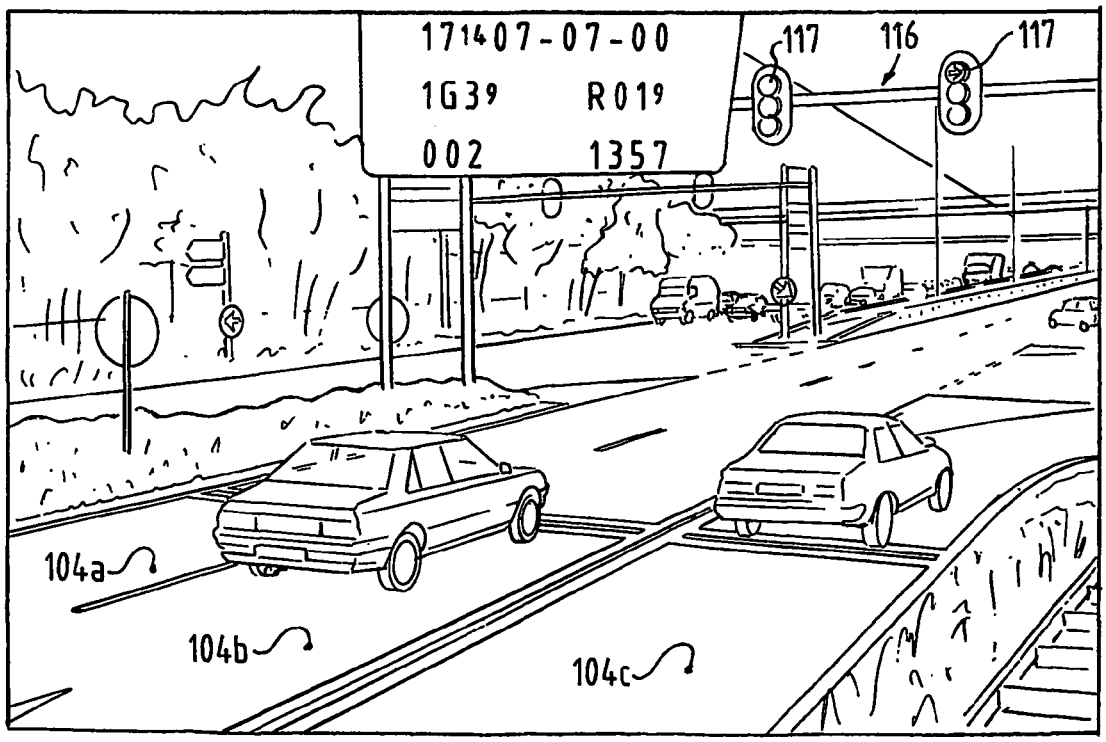
Figure 5:
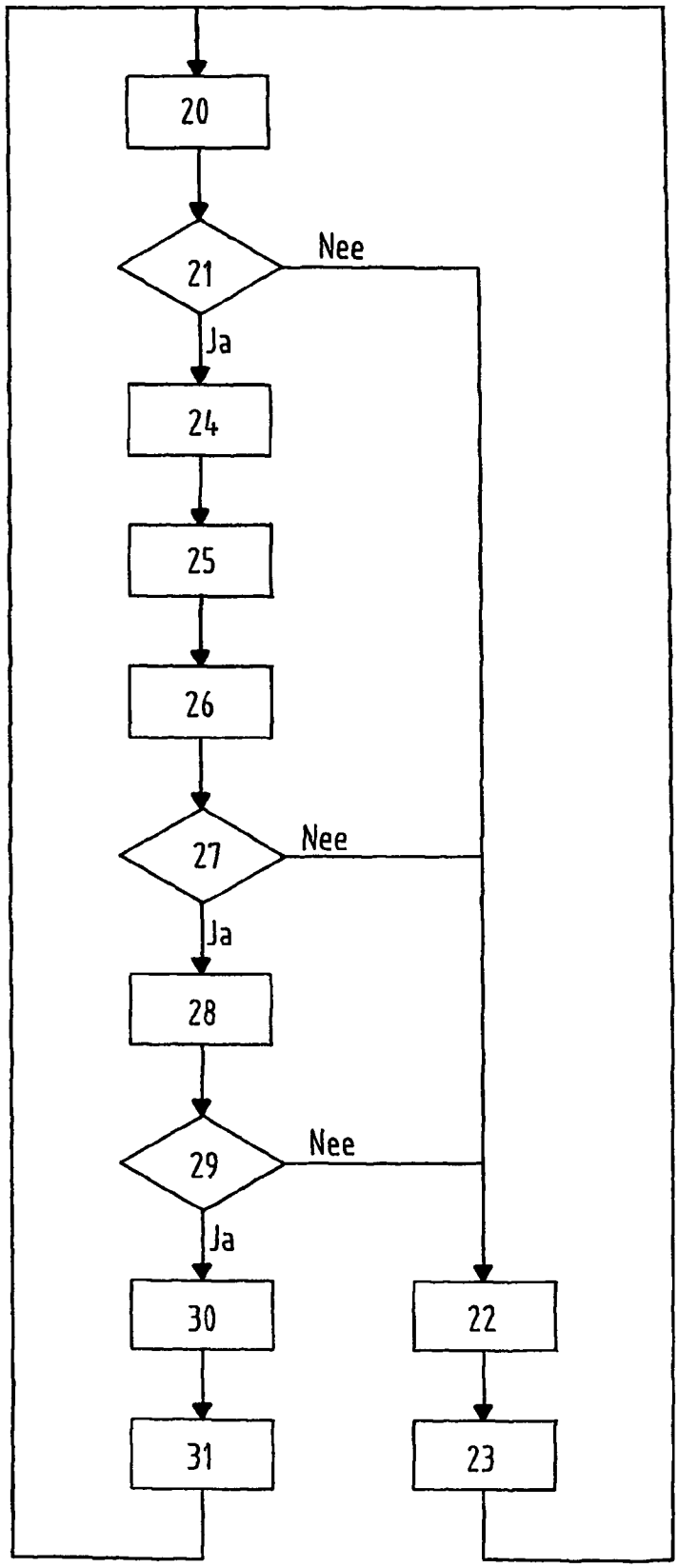

The invention is now elucidated on the basis of a number of embodiments, wherein reference is made to the annexed drawing, in which:

FIG. 1 shows a schematic arrangement for detecting speeding offences on a road with a plurality of lanes, and a central location where license plates of vehicles which have committed offences are read automatically, FIG. 2 shows a record which is made in the setup of FIG. 1 and in which a number of vehicles are shown, one of which has committed a speeding offence, FIG. 3 shows a record which is made during a speed measurement on a road with traffic in two directions, FIG. 4 shows a record which is made by a red-light camera, and FIG. 5 is a flow diagram showing the different steps of the automatic processing of the records made.

A setup for detecting speeding offences by vehicles 1 on a road 2 with a plurality of lanes 3*a*, 3*b*, 3*c* comprises means 4 for detecting an offence, here in the form of a radar trap, and means 5 connected thereto for making one or more records of a vehicle caught exceeding the maximum speed, here in the form of a camera.

The radar trap 4 emits a beam of radar waves 9 at an angle $\alpha$ relative to the longitudinal axis of the road 2. The angle $\alpha$ amounts for instance to about 20°. When a vehicle 1 drives through the radar beam 9 some of the radar waves are reflected by vehicle 1, wherein there will be a frequency difference between the emitted and the reflected waves as a result of the Doppler effect. This frequency difference, which forms a measure for the speed $V_1$ of vehicle 1 in the radar beam 8, is measured, whereafter the speed $V_1$ of vehicle 1 is determined. When this measured speed $V_1$ is higher than the maximum allowed speed $V_{max}$ a signal is generated to camera 5, which then makes one or more records of vehicle 1.

Camera 5 can be an analog camera with film or a digital camera with a memory for storing the records made. In the latter case the camera 5 can be connected via a cable or via a wireless network 6 to a central location 7 to which the records made can be immediately sent for central storage and processing. Use is made here for processing purposes of means 8 for searching in the records and reading a license plate of the vehicle which commits the offence. These search and read means 8 are formed here by a suitably programmed computer which is provided with, among other things, software for optical character recognition (OCR).

So as to easily be able to determine, during examination of the records made, where the vehicle 1 which has committed the offence is located in the record, the recording means 5 are adapted to record information relating to the position of vehicle 1. It is for instance possible to record in which of the lanes 3*a*, 3*b*, 3*c* the vehicle is situated. The highest speeds will generally be reached in the left-hand lane 3*a* (in countries where traffic drives on the right). The measurement can thus be limited to this lane 3*a* by setting a determined measurement range, whereafter this information can be entered once-only by hand by the person operating the measuring equipment. The position information is herein recorded by recording means 5 in a form which can be read by search and read means 8, for instance as attachment 14 to a data file 13 containing the record. In addition, an attachment 15 is also sent with data concerning the nature and seriousness of the offence, for instance the measured speed $V_1$ and the maximum allowed speed $V_{max}$.

Instead of manually inputted position information use could also be made of information obtained during an detection. During measuring of the speed the distance D between vehicle 1 and radar trap 4 could for instance also be measured. On the basis of the known angle $\alpha$ between radar beam 9 and the road 2, the distance d from the vehicle 1 to the edge 10 of road 2 can be calculated from this measured distance D as $$d=D*\sin\alpha$$

This distance to the edge 10 of road 2 can be divided by the known width of a lane, whereafter it is known in which lane the vehicle 1 is located. Since it is known which part of road 2 will be seen in each record and which part is covered by radar beam 9, the search field in the record can be limited on the basis of this information to a strip 11 in which is situated the intersection of radar beam 9 and the lane 3*a* determined or inputted by the distance measurement (FIG. 2). Making use of a suitably chosen search routine and on the basis of specific criteria relating to shape and colour, the license plate 12 of the photographed vehicle 1 is then searched for in this search field, whereafter it can be read by the OCR software.

Instead of a lane in which the vehicle is located, the travel direction of vehicle 1 can also be recorded as position information. Use can be made for this purpose of simple code letters, such as A(way) and F(rontal), which are again recorded in a form readable by the search and read means 8 in or close to the record. On the basis of this position information the search for license plate 12 is then limited to for instance the left or right-hand half of the record (FIG. 3).

It is also possible for the detecting means to be formed by induction loops 104*a*, 104*b*, 104*c* which are arranged in road 102. This will for instance be the case with a red-light camera 105 which is activated when one of the loops 104*a-c* generates a signal that a vehicle 1 is passing in the period that the relevant traffic light installation 116 is generating a signal that the red light 117 is switched on. In this case it is possible to record as position information which of the loops 104*a-c* has detected the passage of the vehicle, and therefore the violation. On the basis hereof the search and read means can then once again limit the search field to a part of the record, for instance a strip along the right-hand edge, when the violation is detected by the detection loop 104*c* in the lane for traffic turning right (FIG. 4).

At the central location 7 the data file 13 having therein the record of vehicle 1 is thus first read by search and read means 8 (block 20 in FIG. 5), whereupon a check is made as to whether there is an attachment 14 with the position information therein (block 21). If no attachment 14 with position information is found, an error signal is generated (block 22) and the data file is displayed as image on a screen to be checked by a staff member (block 23). Search and read means 8 then return to the beginning of the program to read a subsequent data file.

If position information is found, this information is read (block 24), and a part of the record is selected on the basis thereof (block 25). In this selected part a search routine is then carried out to find the license plate 12 (block 26). When this is found (block 27) it is read by the OCR software (block 28). When no license plate is found, an error signal is again generated (block 22) and the data file is again shown on a screen for human checking (block 23).

When the OCR program has read the license plate 12, this latter is outputted (block 29) to a program component which reads the attachment 15 with data of the violation. On the basis of these data and the read license plate 12, the address data of the license holder is searched for in a central register (block 30), whereafter a ticket is printed and sent (block 31). If however the OCR program does not succeed in reading the found license plate 12, an error signal is again generated (block 22) and the data file is again shown as an image to be checked (block 23).

In this manner a large number of records can thus be processed very rapidly, practically without human intervention, whereby the cost of checking traffic violations is limited and the time lapse is moreover shortened, so that the relation between the violation and the ticket becomes more immediate.

Although the invention is described above with reference to embodiments, it will be apparent that it is not limited thereto. Other criteria could for instance be used to select a part of the record for retrieving the license plate. The position information could also be displayed in the record, for instance in the same manner as now happens with information about the violation in conventional records, and could be read therefrom by the search and read means. This is particularly the case when the invention is used in combination with records made with analog cameras. The license plate in the sense of the invention does not otherwise have to be a license plate readable by a person, but could also be formed by a bar code or other machine-readable code. Finally, the invention is of course not limited to use in traffic violations, but other incidents involving a vehicle could also be recorded in the described manner in record which can be analysed quickly and easily on the basis of the selection of a part for examination. It is for instance possible to envisage records of passing vehicles which are made in respect of a toll collection system. The scope of the invention is therefore defined solely by the following claims.

The invention claimed is:

1. A method for recording an incident, in particular a traffic violation, in which a vehicle is involved, comprising the steps of:

detecting the incident, making at least one record of the detected incident, and searching for and reading from the record a license plate of the vehicle involved in the incident, wherein during making of the record, information is recorded relating to the position of the vehicle, and on the basis of this information, a search is made for the license plate in only a part of the record.

2. The method as claimed in claim 1, wherein the recorded position information comprises the travel direction of the vehicle.

3. The method as claimed in claim 2, wherein the record is a picture record and a search for the license plate is made, on the basis of the recorded travel direction, only in a left or right-hand half of the record.

4. The method as claimed in claim 3, wherein a plurality of vehicles are caught in the picture record, and a search is made, on the basis of the recorded position information, for the license plate of only one of the vehicles.

5. The method as claimed in claim 1, wherein the recorded position information comprises the lane in which the vehicle is located.

6. The method as claimed in claim 5, wherein the record is a picture record and a search for the license plate is made, on the basis of the recorded position information, only in a relatively narrow vertical strip of the record.

7. The method as claimed in claim 6, wherein a plurality of vehicles are caught in the picture record, and a search is made, on the basis of the recorded position information, for the license plate of only one of the vehicles.

8. The method as claimed in claim 1, wherein the incident is detected by emitting a signal and analysing a signal reflected by the vehicle, and a set transmission range is recorded as position information.

9. The method as claimed in claims 1, wherein the incident is detected by making use of a number of fixed detection elements, and the identity of the detection element detecting the incident is recorded as position information.

10. The method as claimed claim 1, wherein during detecting of the incident the distance to the vehicle is measured and recorded as position information.

11. A method for recording an incident, in particular a traffic violation, in which a vehicle is involved, comprising the steps of:

detecting the incident, making at least one record of the detected incident, including recording information relating to the position of the vehicle, and on the basis of the recorded position information, searching only a part of the record for a license plate of the vehicle involved in the incident, wherein the recorded position information includes the direction of travel of the vehicle.

12. The method as claimed in claim 11, wherein the record is a picture record and a search for the license plate is made, on the basis of the recorded travel direction, only in a left or right-hand half of the record.

13. The method as claimed in claim 12, wherein a plurality of vehicles are caught in the picture record, and a search is made, on the basis of the recorded position information, for the license plate of only one of the vehicles.

14. The method as claimed in claim 11, wherein the incident is detected by emitting a signal and analysing a signal reflected by the vehicle, and a set transmission range is recorded as position information.

15. The method as claimed claim 11, wherein during detecting of the incident the distance to the vehicle is measured and recorded as position information.

16. A method for recording an incident, in particular a traffic violation, in which a vehicle is involved, comprising the steps of:

detecting the incident, making at least one record of the detected incident, including recording information relating to the position of the vehicle, and on the basis of the recorded position information, searching only a part of the record for a license plate of the vehicle involved in the incident, wherein the recorded position information includes the lane in which the vehicle is travelling.

17. The method as claimed in claim 16, wherein the record is a picture record and a search for the license plate is made, on the basis of the recorded position information, only in a relatively narrow vertical strip of the record.

18. The method as claimed in claim 17, wherein a plurality of vehicles are caught in the picture record, and a search is made, on the basis of the recorded position information, for the license plate of only one of the vehicles.

19. The method as claimed in claim 17, wherein the incident is detected by making use of a number affixed detection elements, and the identity of the detection element detecting the incident is recorded as position information.

20. A system for recording an incident, in particular a traffic violation, in which a vehicle is involved, comprising:

a detector unit for detecting the incident, a recorder connected to the detector unit for making at least one record of the detected incident, and a reader for searching for and reading from the record a license plate of the vehicle involved in the incident, wherein the recorder is adapted to record information relating to the position of the vehicle, and the reader is adapted to search for the license plate, on the basis of the position information, in only a part of the record.

21. The system as claimed in claim 20, wherein a plurality of vehicles are caught in the record and the reader is adapted to search, on the basis of the recorded position information, for the license plate of only one of the vehicles.

22. The system as claimed in claim 20, wherein the recorder is adapted to make picture records, and the reader is adapted to identify and read the license plate from the picture record by optical means.

23. The system as claimed in claim 22, wherein the recorder is an analog camera making picture records on film.

24. The system as claimed in claim 22, wherein the recorder is a digital camera including a memory for storing the picture records made.

25. The system as claimed in claim 24, wherein the camera is arranged near a road and the reader is arranged at a central location remote from the road, the camera being connected to the central location via a cable or a wireless network.

26. The system as claimed in claim 22, wherein the reader comprises a suitably programmed computer including software for optical character recognition.

27. The system as claimed in claim 20, wherein the detector unit comprises a radar trap arranged near a road.

28. The system as claimed in claim 20, wherein the detector unit comprises a plurality of induction loops arranged in a road.

29. A system for recording an incident, in particular a traffic violation, in which a vehicle is involved, comprising:

a detector unit arranged in or near a road on which vehicles travel for detecting the incident, a camera arranged over or near the road and connected to the detector unit for making at least one pictorial record of the detected incident, the camera being adapted to include in the record information relating to the position of the vehicle, and a reader for searching, on the basis of the recorded position information, only a part of the record for a license plate of the vehicle involved in the incident and for reading the license plate from the record, the reader being adapted to identify and read the license plate from the pictorial record by optical means.

30. The system as claimed in claim 29, wherein the reader comprises a suitably programmed computer including software for optical character recognition.

31. The system as claimed in claim 30, wherein the camera is a digital camera including a memory for storing each pictorial record made, the camera being adapted for recording the position information as attachment to a data file containing the pictorial record.

32. The system as claimed in claim 30, wherein the camera is an analog camera adapted for making pictorial records on film and for displaying the position information in each pictorial record.

33. The system as claimed in claim 30 or 31, wherein the reader is adapted to search the record for position information, to select a part of the record on the basis of this position information, and to search only the selected part of the record for the license plate of the vehicle.

34. The system as claimed in claim 33, wherein the reader is adapted to display the record as image on a screen for human checking if no position information is found.

* * * * *